US008439159B1

(12) United States Patent
Borla

(10) Patent No.: US 8,439,159 B1
(45) Date of Patent: May 14, 2013

(54) EXHAUST MUFFLER FOR INTERNAL COMBUSTION ENGINES

(76) Inventor: Alexander Borla, Johnson City, TN (US)

( * ) Notice: Subject to any disclaimer, the term of this patent is extended or adjusted under 35 U.S.C. 154(b) by 0 days.

(21) Appl. No.: 13/134,651

(22) Filed: Jun. 13, 2011

Related U.S. Application Data

(60) Provisional application No. 61/402,458, filed on Aug. 30, 2010.

(51) Int. Cl.
*F01N 1/24* (2006.01)

(52) U.S. Cl.
USPC ..... 181/257; 181/212; 181/227; 181/228

(58) Field of Classification Search ..... 181/257, 181/212, 227, 228
See application file for complete search history.

(56) References Cited

U.S. PATENT DOCUMENTS

| | | | | |
|---|---|---|---|---|
| 5,198,625 | A * | 3/1993 | Borla | 181/248 |
| 5,731,557 | A * | 3/1998 | Norres et al. | 181/233 |
| 6,135,237 | A * | 10/2000 | Allman | 181/282 |
| 6,164,412 | A * | 12/2000 | Allman | 181/272 |
| 6,385,967 | B1 * | 5/2002 | Chen | 60/312 |
| 7,364,011 | B2 * | 4/2008 | Hirschorn et al. | 181/248 |
| D575,213 | S * | 8/2008 | Kryssing et al. | D12/194 |
| D578,050 | S * | 10/2008 | Hsu | D12/194 |
| 7,510,050 | B2 * | 3/2009 | Emler | 181/249 |
| 8,042,649 | B2 * | 10/2011 | Inoue | 181/252 |

* cited by examiner

*Primary Examiner* — Forrest M Phillips

(57) ABSTRACT

A new and improved muffler for use particularly with internal combustion engines which utilizes a tube assembly composed of a plurality of laterally nested perforated and non-perforated tubes in direct supporting lateral engagement with each other wherein the perforations provide direct communication of exhaust gases therebetween and wherein the tube assembly is supported at opposite ends by frustoconical entrance and exit collars, the larger ends of the collars being crimped or otherwise secured thereto providing a sealed connection.

26 Claims, 8 Drawing Sheets

SINGLE CORE

SERIES MULTI CORE

PARALLEL MULTI CORE

MULTI CORE 2 IN 1 OUT

EXHAUST MUFFLER FOR INTERNAL COMBUSTION ENGINES

This application claims priority under 35 U.S.C. 119(e)(1) based on Applicants Provisional U.S. Patent Application Ser. No. 61/402,458 filed 8-30-10 and titled "AUTO MUFFLER CONSTRUCTION".

BACKGROUND OF THE INVENTION

This invention relates in general to silencing high velocity air or gas exhaust flow to atmosphere or the like, and is particularly directed to mufflers for use with internal combustion engines and the like.

The problem of muffling the noise generated or emitted in the exhaust gases from the internal combustion engine is well known. Many types of mufflers and noise reducing devices have been developed to address this problem. One type of muffler generally referred to an absorption muffler directs exhaust gas straight through a perforated tube with a uniform configuration from end to end with sound deadening material such as glass fibers between the tube and an outer housing. These mufflers are advantageous in that they provide lower back pressure, but are not very effective in reducing the level of noise.

Another type of muffler is one characterized as a resonator. This type of muffler uses a series of baffle plates to radially change the path of the exhaust gases. By interrupting or changing the direction of gas flow, sound frequencies passing therethrough are reflected back toward the noise source by the baffle plates thus mechanically canceling each other where they meet. This type of muffler does reduce noise to some extent, however, the back pressure of the exhaust tends to increase due to the blocked exhaust flow.

The object of the present invention is to provide a muffler that not only successfully reduces the noise level but also has little or no back pressure.

Another object is to provide such a muffler which is economical in construction, reliable in operation, rugged and able to withstand automotive racing use for sustained periods, and which has a compact configuration compatible with under-vehicle mounting.

SUMMARY OF THE INVENTION

The present invention concerns a compact absorption-type muffler or silencer for a fluid flow, such as the flow of exhaust gas from an internal combustion engine. The muffler effectively attenuates noise transmitted within the fluid exhaust flow in a manner similar to resonators and throttling mufflers while developing only a low back pressure in the flow. The structure of the muffler permits its tuning for accommodating sound conscious auto owners who wish to give unique muffler sound to their auto.

The invention is directed to a muffler for sound attenuating an internal combustion engine exhaust while maintaining little or no back pressure and achieving minimal decibel noise readings. Among the several features of the novel muffler in accordance with this invention are the provision of an outside shell which houses an array of a combination of at least three generally parallel tubes, at least one of which is perforated and at least one of which is not perforated, wherein the tubes are nested in laterally contacting relationship and wherein in particular the spatial relationship between the muffler shell (can, housing) and array structures is tailored to meet the sound objectives. These nested tubes are supported at each end by frustoconically shaped collars which have been crimped and/or welded to the tube ends. The collars extend in opposite directions through openings in end caps and are connected to inlet and outlet ducts, the inlet collar serving as a collector accelerator. Sound attenuating material such as steel wool, fiberglass or ceramic fiber is packed between the tube and collar assembly and the outside shell. However, effective sound attenuation can also be achieved without the use of any packing material.

The muffler of the present invention allows rapid expansion of exhaust gas as it enters from the inlet duct into the entrance collar, thereby allowing it to drop in temperature and change the acoustical frequency therein. From the entrance expander collar, the exhaust gas enters the laterally nested array of tubes, where the slower moving acoustical pulses bounce through the holes or perforations in a select number of the tubes thus canceling each other where they collide. Other pulses enter the material surrounding the tubes and are absorbed as heat. Upon entering the outlet accelerator collar, the flow accelerates and the frequencies recombine, thus allowing a substantially uninterrupted flow of exhaust gas creating little or no back pressure while also allowing minimal noise emissions.

A further feature of the invention is the arrangement of the tubes in a laterally nested array of the same or differing tube diameters to assist in providing unrestricted flow, particularly thru the non-perforated tubes, with little or no back pressure in a compact arrangement, while also permitting a wide latitude for design variations to accomplish differing tuning effects in a range of muffler models.

Another feature of the invention is to provide such an array of nested tubes in a twisted or helical bundle, thereby enabling the use of tubes which are longer than straight tubes without thereby increasing the overall length of the muffler while still obtaining substantially unrestricted flow with little or no back pressure.

Further features and variations of the invention are crimped or necked down portions in one or more of the nested tubes at suitably spaced intervals to obstruct or change the flow of exhaust, a center tube which has been pinched closed functioning as a closure plate to alter the flow of exhaust, and blockage of the entrance of the center tube with a perforated cone.

The foregoing and other objects, features and advantages will become apparent to those skilled in the art upon reading the description of a preferred embodiment, which follows, in conjunction with a review of the appended drawings which may not be to scale and are intended to illustrate principles of the invention and preferred structures.

PREFERRED EMBODIMENT

Figure 1:
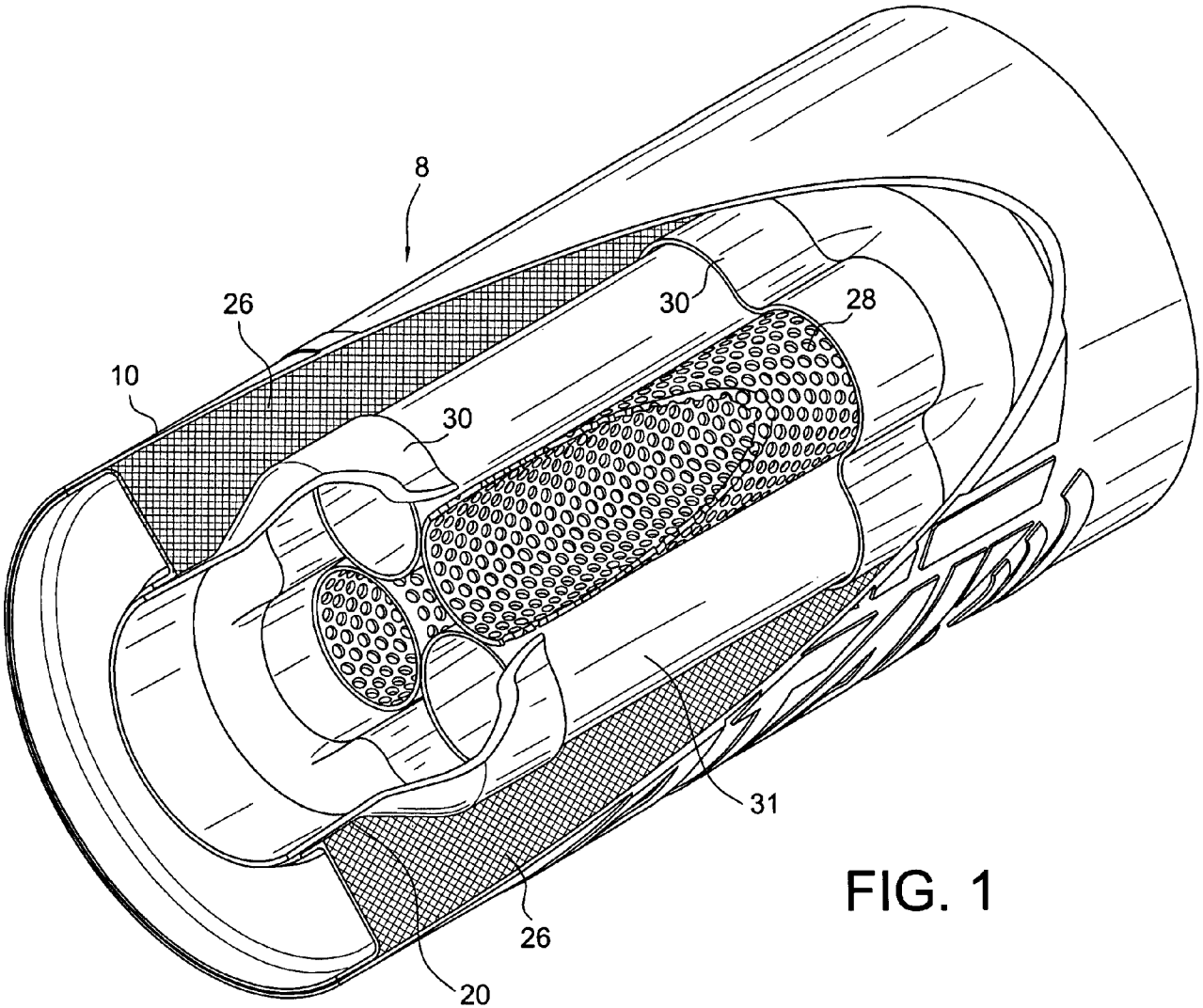
FIG. 1 is a perspective view, partially sectioned, of one working exemplary but present preferred embodiment of the invention.
Figures 1A, 2:
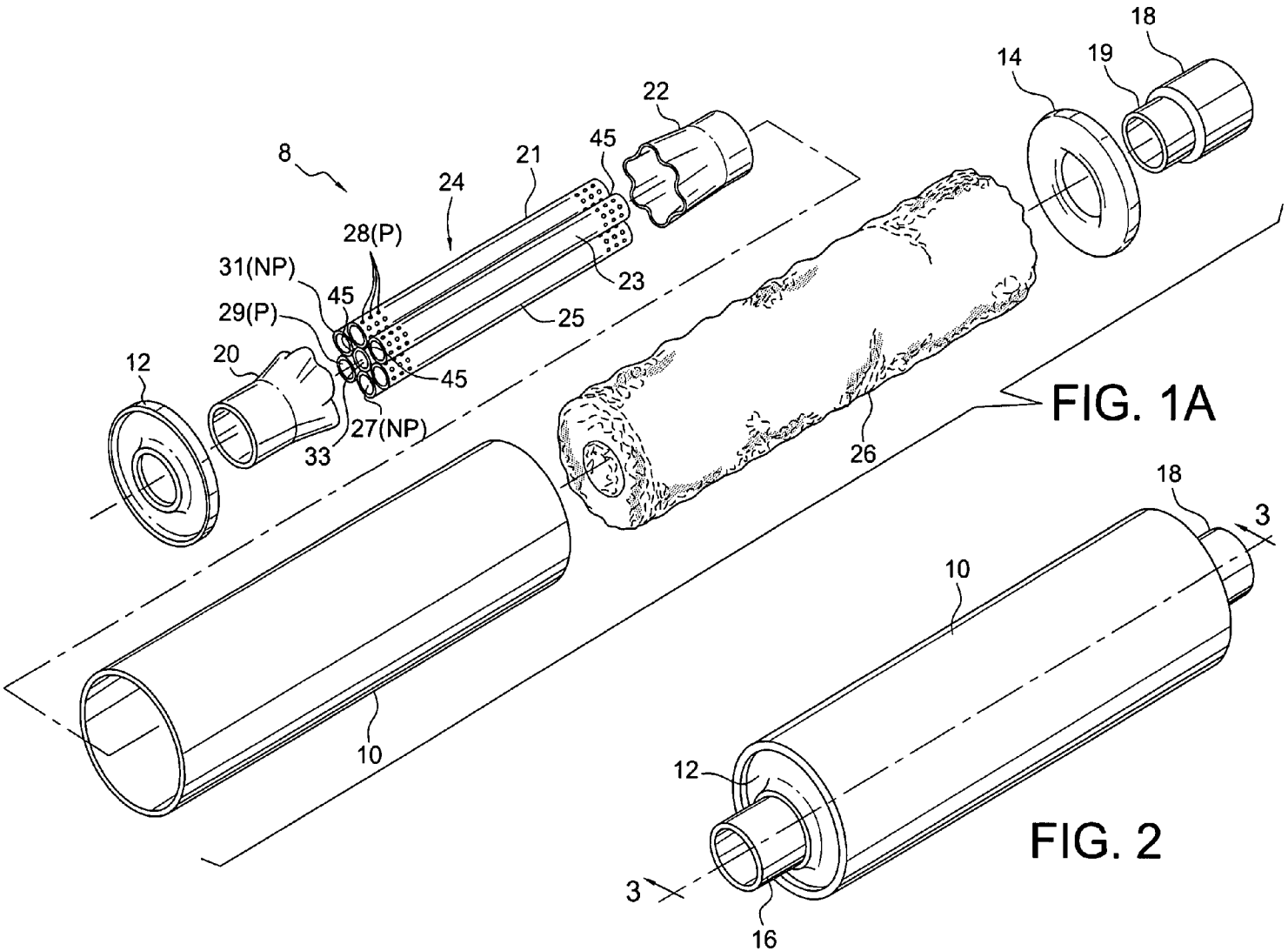
FIG. 1A is an exploded perspective view of a muffler of the general construction as in FIG. 1.
FIG. 2 is a perspective view of a muffler in accordance with the embodiment of FIG. 1.

FIGS. 1 and 2 illustrate a muffler 8 of any configuration which includes a generally cylindrical shell (casing, can or housing) 10 with open ends. Secured to and telescoped within each end of shell 10 are dual, flanged end caps 12 and 14 each having a center flanged opening therein for connection with respectively associated inlet and outlet ducts 16 and 18. Inlet and outlet ducts 16 and 18 have reduced diameter portions 17 and 19, respectively, adapted to be telescopically received within cylindrical portions 37 and 39 of entrance and exit collars 20 and 22, respectively. It is also contemplated to make the entrance duct 16 and entrance collar 20 as one piece, as well as the exit duct 18 and exit collar 22. In this instance, the inlet and outlet ducts 16 and 18 would have a constant diameter equal to portions 37 and 39 of the entrance and exit collars. Of course, the openings in end caps 12 and 14 would be sized to accommodate the dimensions of the entrance and exit duct/collar assembly. The inlet duct 16 and outlet duct 18 are respectively intended for connection to an exhaust manifold pipe of an internal combustion engine and to a vehicle exhaust tailpipe, not shown. The inlet end and outlet duct 16 and 18 are respectively connected to frustoconically shaped entrance and exit collars 20 and 22 which support a nested tube subassembly 24. The tube subassembly 24 is made of at least three (3) laterally nested tubes 21', 27', 29' as seen for example, in the embodiment of FIG. 6, and is supported by the entrance and exit collars 20 and 22 at opposite ends thereof. The tube subassembly 24 as seen in the embodiment of FIG. 1 is composed of seven tubes 21, 23, 25, 27, 29, 31, 33 of equal diameter disposed in a packed or nested array so as to extend parallel to one another with mutually adjacent tubes in lateral contact. The tubes are welded together at their ends as seen in FIG. 1 at 45. The space between the tube assembly 24 and the housing is filled with sound attenuating material 26 such as steel wool, fiberglass or ceramic fiber. The present muffler also effectively attenuates sound without the use of packing materials when the muffler is used, for example, in a marine environment.

Figure 3:
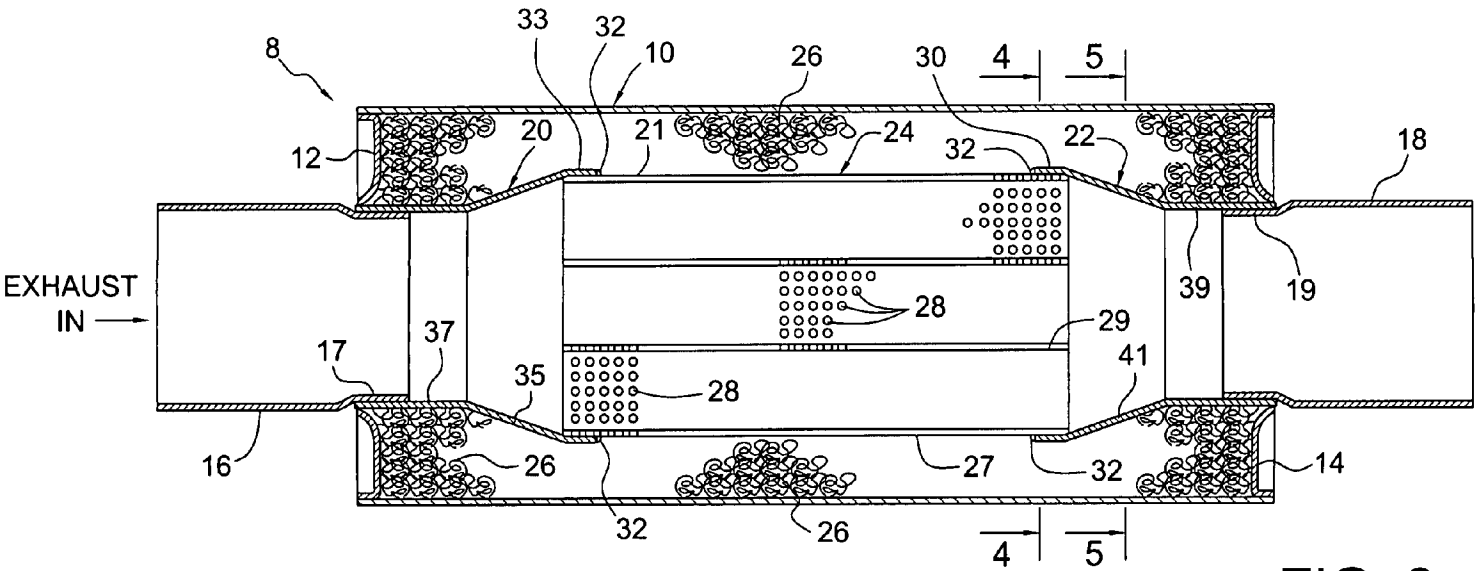
FIG. 3 is a cross sectional view taken along line 3-3 of FIG. 2.
Figure 5:
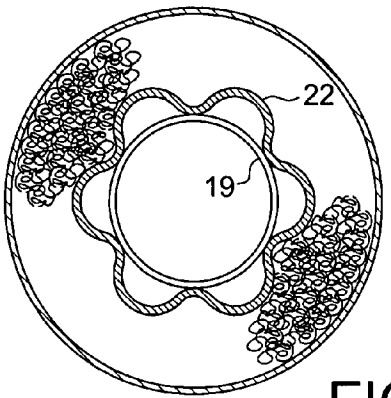
FIG. 5 is a cross sectional view taken along line 5-5 of FIG. 3.
Figure 4:
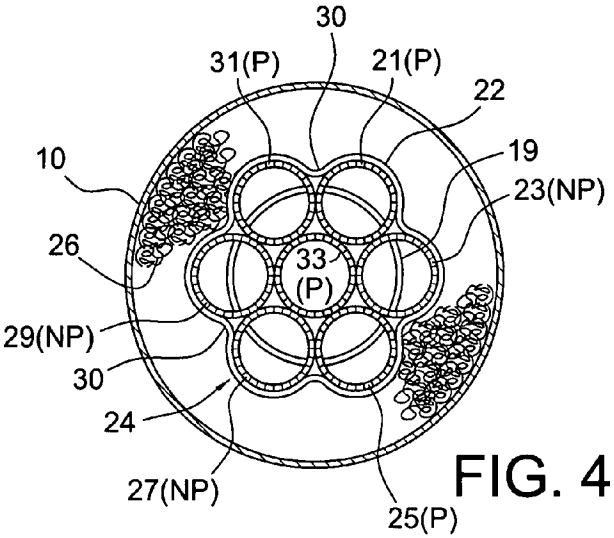
FIG. 4 is a cross sectional view taken along line 4-4 of FIG. 3.

The nested tube subassembly 24 is supported at opposite ends by the entrance and exit collars 20 and 22, the larger ends of which have been crimped thereto as seen most clearly in FIGS. 3 and 4. Entrance and exit collars 20 and 22 have cylindrical portions 37 and 39, respectively. Portions 37 of entrance collar 20 expands conically in the direction of exhaust flow into a diffuser expander 35. The diffuser-expander 35 telescopically receives the upstream end of tube subassembly 24 and is crimped and welded thereto to ensure that the exhaust gases flow directly and substantially unimpeded into the tube subassembly 24. The exit collar 22 is similarly shaped and connected to the downstream end of the tube subassembly 24, with the conical expansion serving as a collector-accelerator 41. Holes or perforations 28 provide direct and indirect communications between the tubes, allowing the exhaust gas to flow directly from one tube to another, and indirectly from the tube subassembly 24 through the perforated holes 28 into the sound attenuating material 26 in which the noise is dissipated and back into the same or different tube via these holes.

The present invention which includes the of the combination of perforated and non-perforated tubes adds a new dimension to the tuning capability of the present muffler design.

Further, an important aspect of the present invention is the recognition that a much greater control over the tuning of mufflers of the general type as shown in U.S. Pat. No. 5,198,625 can be achieved by employing the combination of perforated and non-perforated tubes in a tube assembly and particularly where the position or posture of the tube assembly within the muffler can, shell or housing, e.g., longitudinally and/or radially thereof can be readily varied, and wherein the relative dimensions of the shell and tube assembly, e.g., tube length vs. shell length, can also be varied in order to meet the muffler sound requirements.

In certain preferred embodiments, the total area covered by perforations 28 can range from about 5.0% to about 80.0% of the total surface area of all tubes in the array and preferably 20.0% to 40.0%, thus such a range allows the selection of a desired degree of gas intercommunication between the perforated tubes to provide, in association with the non-perforated, straight thru tubes, a much greater tuning capability than heretofore possible. An excellent tuning range is afforded by the following structural set wherein the lengths and volumetric capacities of all tubes are within 30% of each other.

| | Preferred | Most Preferred |
|---|---|---|
| Perforated tubes | 1-10 | 2-8 |
| Non-perforated tubes | 1-10 | 2-8 |
| Total open perforated area of all perforated tubes | 10-90% | 20-40% |

Further tuning capability is afforded by the present muffler construction shown in FIG. 3 wherein the length and diameter (or volume) of each tube can be varied during manufacture and wherein the collectors (entrance and/or exit collars) are configured to receive the non-planar tube end array. In addition, the muffler outer housing may be any shape, e.g., round, square, oval, other, the core (array) can be at most any angle in the can but is in line with the flow, there can be multi cores in a single muffler in series or parallel, the % open area as above with most typically about 29.6% of each tube wall area, the tubes are all cut to 90 deg., the core (array) can be shifted front to back and in the case of series cores the space between them and the shell can be adjusted to tune the sound, the size of the outer housing is also part of the tuning process, the location and combination ratio of perforated to non-perforated tubes in the core bundle is part of the tuning, and the stagger pattern of perforations, hole size, % open wall area, perforations per square inch are taken into consideration.

In operation, the exhaust gases flow from the entrance duct 16 into the entrance collar 20 where the gases are diffused or rapidly expanded, thereby dropping in temperature and changing the acoustical frequency of the sound waves inside the entrance collar. The exhaust gas then flows unobstructed from the entrance collar 20 to the tube subassembly 24 where the slower moving acoustical pulses bounce through the holes or perforations 28 from one tube to another, canceling each other where they collide. Other acoustical pulse flow through the perforations 28 and enter the sound attenuating material 26 or packing around the tubes and are absorbed as heat. The various frequencies of sound waves, along the diffused exhaust gas flow in packing 26 then reenter the tubes through the perforations 28 near the downstream end of the tube subassembly 24 and enter unobstructed through the exit collar 22 where the frequencies recombine and accelerate, thus further canceling where they meet.

One of the main advantages the present invention affords over prior straight through mufflers is that the prior art mufflers provide little surface area over which the exhaust gases may flow. The present invention provides a greater surface area over which the gases may flow in order to provide greater opportunities for the frequencies to be reflected, thus canceling or being otherwise attenuated where they meet. In addition, the exhaust gases are divided into small streams which allows the gases to expand even further. Furthermore, the muffler of the present invention, by providing tubes in direct contact with each other, allows the slower moving acoustical frequencies to communicate via the perforations or holes in the tubes directly from one tube to another providing maximum opportunities for the frequencies to collide and cancel each other out. By providing the combination of straight through tubes and perforated tubes the muffler provides both a greater amount of surface area per unit volume over which the exhaust gases are directed, and maximum noise attenuation with little or no back pressure while maintaining a compact array.

Figure 6:
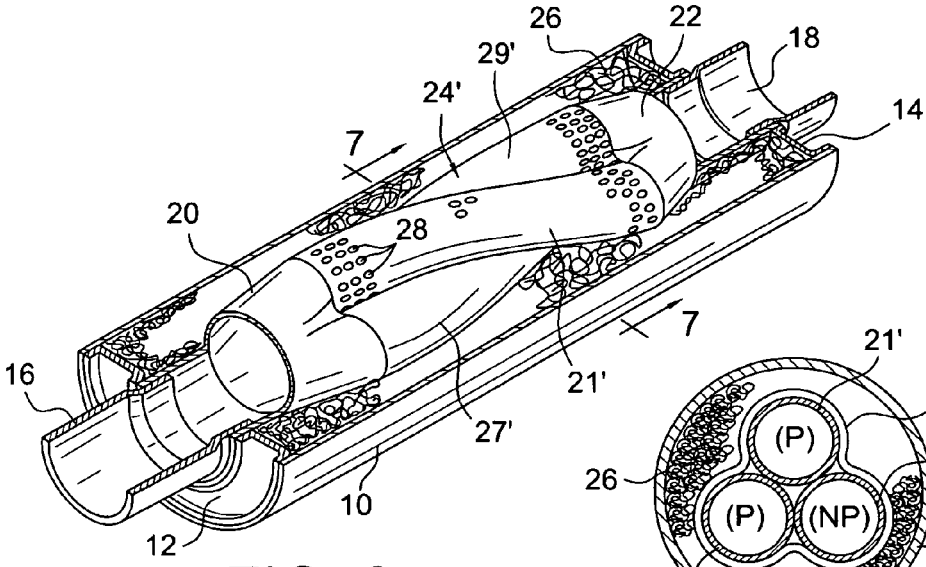
FIG. 6 is a perspective cut-away view of a second preferred embodiment of the invention.
Figure 7:
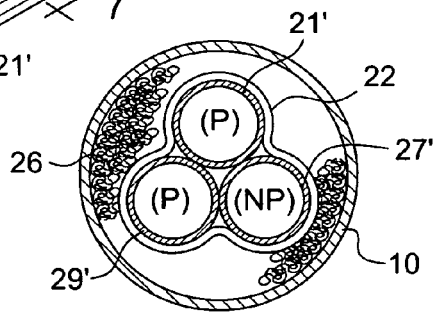
FIG. 7 is a cross sectional view taken along line 7-7 of FIG. 6.
Figure 8:
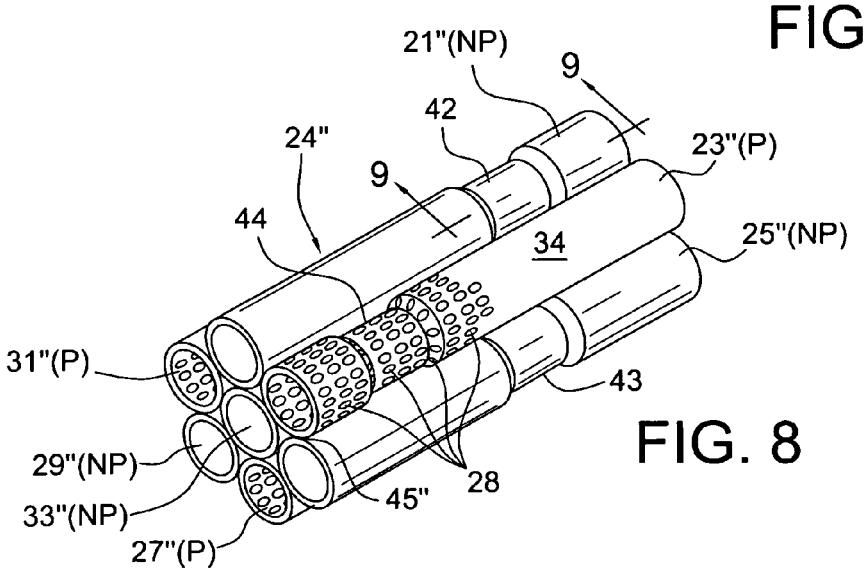
FIG. 8 is a perspective view of a third embodiment of a nested tube assembly utilizable in the muffler of the invention.

The embodiment of FIGS. 6 and 8 functions essentially the same as the embodiment of FIGS. 1-5 above. However, as seen in FIG. 6, the tube assembly 24' comprises tubes 21', 27', 29' that are twisted in a helical bundle. This allows tubes of longer length to be used within the same overall muffler length, thus providing an even greater amount of surface area over which the exhaust gases flow without requiring the outer casing to be lengthened. The twisted or helical tube assembly 24' allow discharge of exhaust gases at a substantially constant flow rate through tubes of longer length than straight tubes, reducing loses induced by high back pressure while allowing maximum reduction of noise. The helical flow path also is effective in promoting sound wave attenuation.

Figure 9:
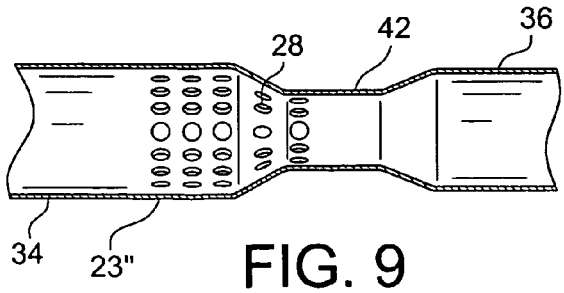
FIG. 9 is a cross sectional view taken along line 9-9 of FIG. 8.

Referring to FIGS. 8 and 9, in which another embodiment of the laterally nested tube subassembly 24" is shown, the tubes are crimped or necked down at predetermined selected and spaced locations 21, 23 and 25 along their lengths. The crimped tubing arrangement varies the flow of exhaust by creating a venture-like effect at the crimped portions 21, 23 AND 25. The gases flow from an expanded condition in portion 30 of the tube, as seen in FIG. 9 into the crimped portion 21 where the gases are contracted and accelerated. The gases then flow from venturi portion 21 into portion 32 where the gases are again expanded. As the gases pass through the crimped portion 21, some exhaust may be forced through the perforations 21 into adjacent tubes where they expand, and collide with the sound waves propagated by such flow waves in the adjacent tubes, attenuating or canceling each other out. Other exhaust frequencies are forced through the perforations to enter the housing space surrounding and outside of the tube assembly, and dispense into sound attenuating material 26. Forcing the gases through the crimped portions 28 allowing the exhaust gases to contract and expand at various locations thus affords further opportunities for the frequencies to collide and cancel each other out for further sound attenuation. The selection of crimping locations and venturi diameter in a given tube, as well as the number of such crimps per tube, and the interrelationship of such venture locations tube-to-tube, provides a high degree of design flexibility to enable achievement of a variety of tuning effects.

Figure 10:
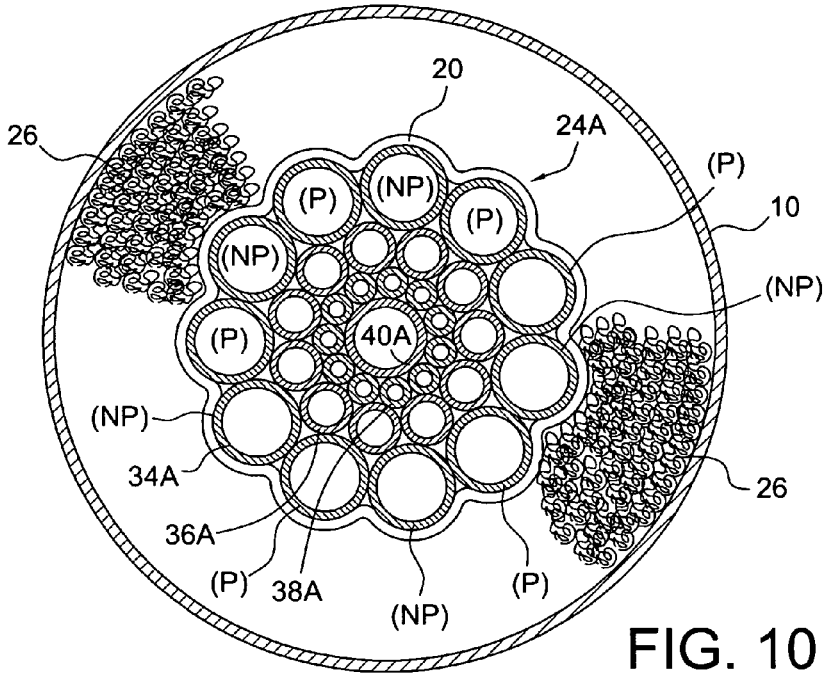
FIG. 10 is a cross sectional view of a fourth embodiment of the nested tube assembly utilizing tubes of different diameters, the section being taken in a location similar to that of FIG. 7.

Referring to FIG. 10, another embodiment of the invention is shown which utilizes a tube subassembly 24" composed of perforated tubes of varying diameters. In a preferred arrangement, tubes 34 of largest diameter are arranged parallel in a circular array to form the outermost array concentrically enveloping the inner circular arrays of tubes 36 and, likewise, tubes 38 form an array concentrically enveloping the inner circular array of tubes 38. Array 38 concentrically envelopes, surrounds and laterally contacts a center-most tube or diffuser 40 which may have a diameter substantially the same as or slightly smaller than the diameter of the outermost tubes 34. Again, the tubes are in laterally contacting relationship with mutually adjacent tubes. The exhaust gases are directed from the entrance collar directly into the tubes. Here again, some of the exhaust flows from larger tubes to smaller tubes, and vice versa, through the tube perforations, thus allowing the exhaust to expand and contract to provide further opportunities for the gas propagated sound waves of various frequencies to collide and cancel each other. This varying tube diameter configuration may be used in a straight tube assembly or in a twisted helical tube assembly.

It is also contemplated to roll down or fully crimp the center tube 33" or diffuser so that the same is completely closed, the crimp acting as a closer plate. The entrance to the diffuser may additionally or alternative be blocked by a perforated cone with the cone vertex extending toward the entrance collar into the gas flow. In this configuration, exhaust gases flowing from the entrance collar will flow directly and substantially unobstructed into the tube surrounding the diffuser. Limited exhaust may flow into the diffuser through the perforated cone. Exhaust gas may also enter the diffuser directly from adjacent tubes through their respective perforations. The diffuser thus acts as a further collection chamber for guiding and slowing the velocity of the exhaust gases.

Figure 11:
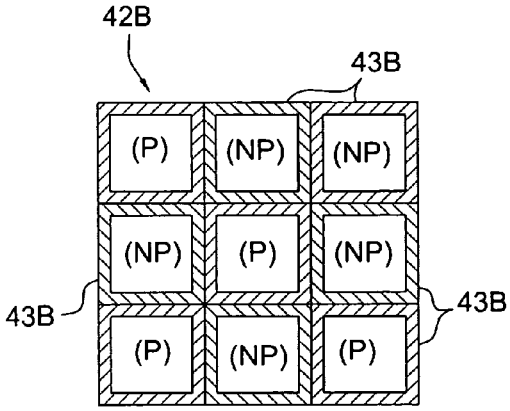
FIG. 11 is a cross sectional view of a fifth embodiment of the nested tube assembly utilizing rectangular tubes arranged into a generally rectangular array, the section being taken in a location similar to that of FIG. 7.
Figure 12:
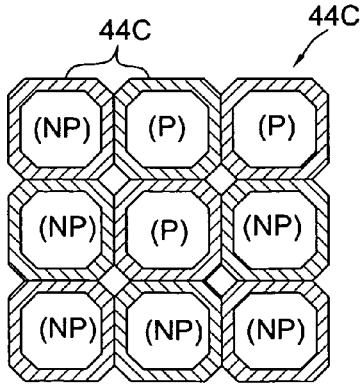
FIG. 12 is a cross sectional view of a sixth embodiment of the nested tube assembly utilizing octagonal tubes arranged into a generally rectangular array, the section being taken in a location similar to that of FIG. 7.
Figure 13:
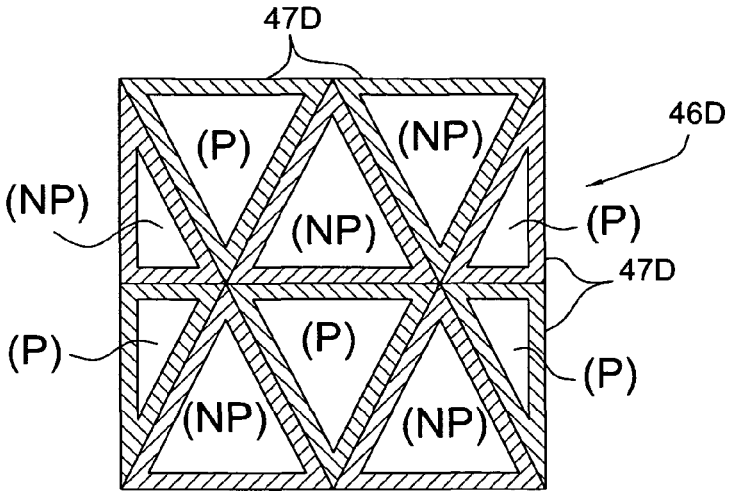
FIG. 13 is a cross sectional view of a seventh embodiment of the nested tube assembly utilizing triangular tubes arranged into a generally rectangular or triangular array, the section being taken in a location similar to that of FIG. 7.

This invention is intended to also cover housings and tubs of various configurations and combinations. For example, FIG. 11 shows an arrangement of nested square tubes 43. Octagonal tubes **44*a* and triangular tubes 47 are seen in nested assemblies 44 and 46 in FIGS. 12 and 13**, respectively.

Figure 14:
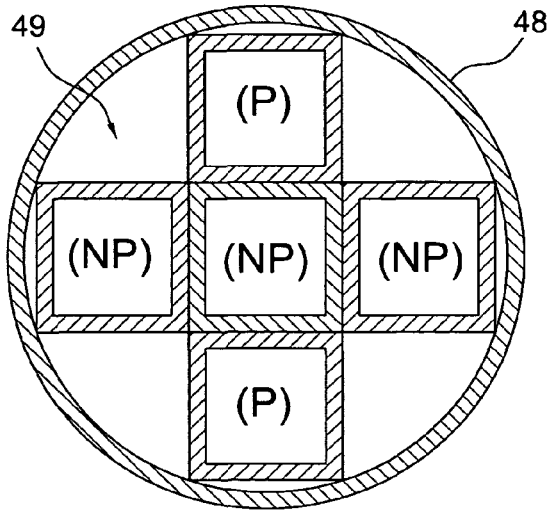
FIG. 14 is a cross sectional view of an eighth embodiment of the nested tube assembly utilizing rectangular tubes arranged into a generally elliptical array, the section being taken in a location similar to that of FIG. 7.
Figure 15:
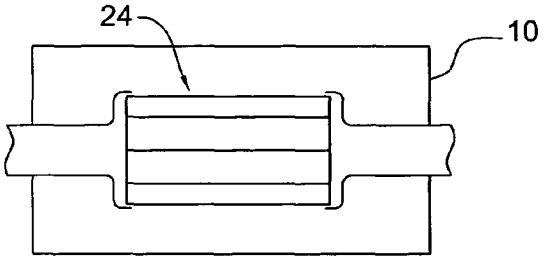
FIGS. 15-18 show variations in the placements and configurations of the present tube arrays within the muffler housing.
Figure 16:
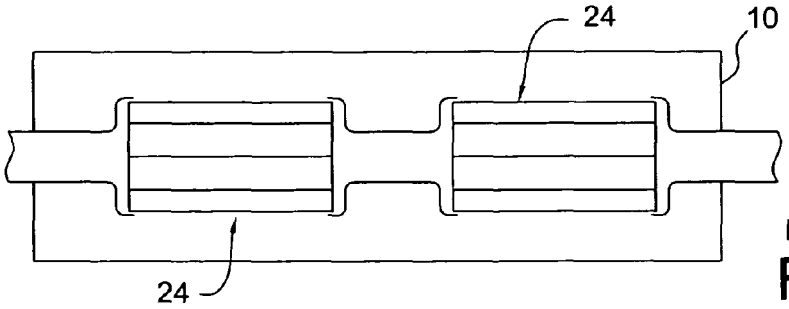
Figure 17:
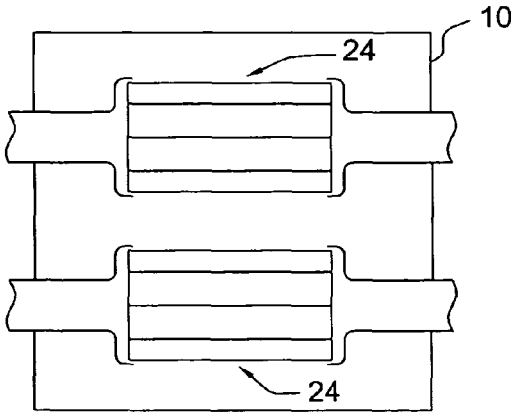
Figure 18:
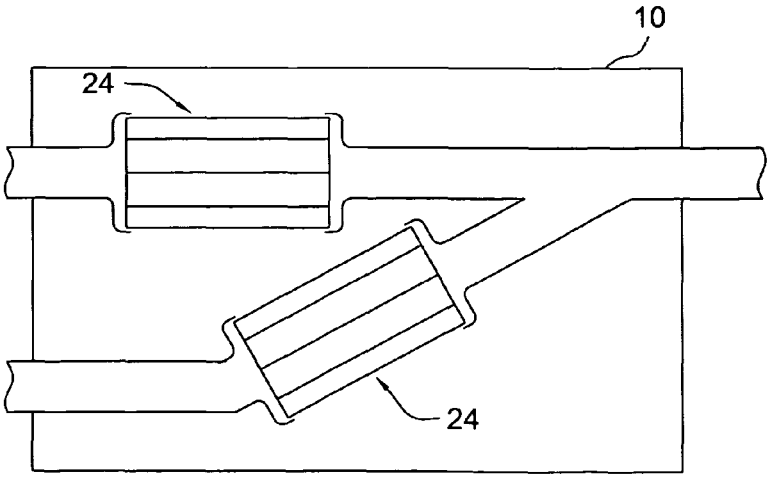
Figure 20:
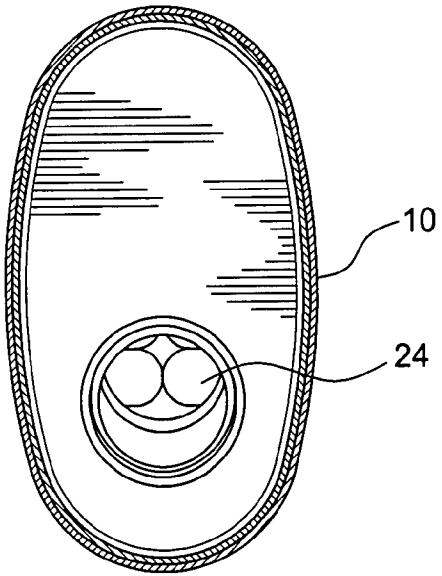
FIG. 20 is an end view taken along line 20-20 in FIG. 19.
Figure 19:
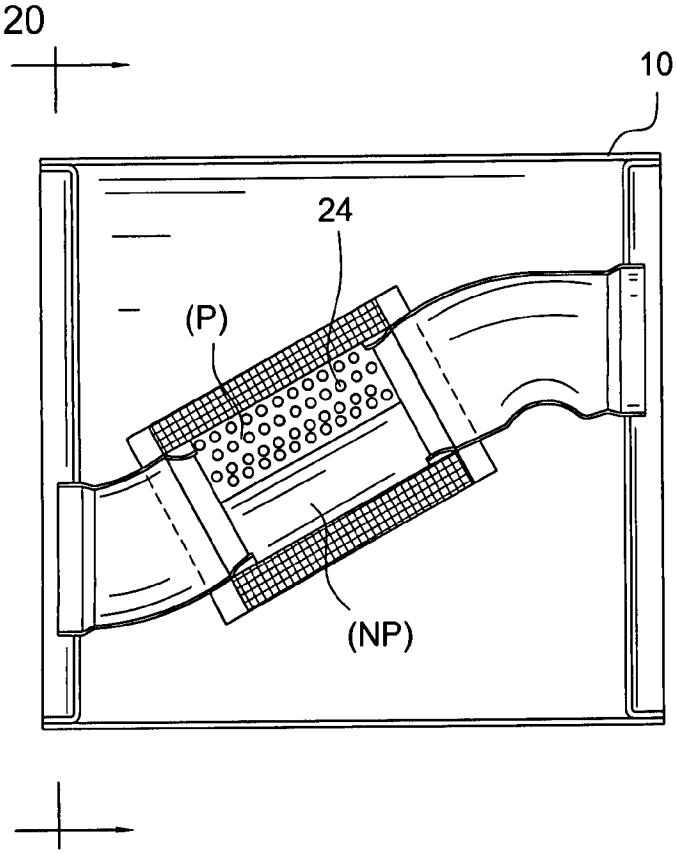
FIG. 19 is a cross-sectional view of an angled array within the can.

One advantage of using non-round tubes is increased gas velocity. In circular or round tubes, the exhaust tends to follow the curved wall surfaces of the tube and swirl or spiral, thus reducing its velocity. With tubes having flat surfaces, the exhaust shoots straight through without any substantial swirling effect. These tube assemblies may be enclosed within a housing having a round, oval, square or triangular configuration. For example, FIG. 14 shows a round housing 48 enclosing a square tube assembly configurations may be used.

In addition, other methods of construction of the housing are possible. For example, the muffler could be made of two halves of stamped and deep drawn shells resistance welded together along the longitudinal seam and incorporating the end caps therein. Examples of such muffler housing can be seen in U.S. Pat. Nos. to Ferralli 4,153,136, Meier 4,252,212, Daude et at 4,356,886 and Blanchot 4,456,091.

A preferred aspect of this invention is the fact that in all the described embodiment above, the tubes are in direct supporting engagement with each other. Through communication of the holes between the tubes, the acoustical frequencies have more opportunity to collide, thus canceling or otherwise attenuating each other where they meet. In the arrangement using tubes of varying diameter, the exhaust gases are allowed to flow through the perforations or holes from larger diameter tubes to smaller diameter tubes, and vice versa. Thus the gases are allowed to expand and contact, offering further opportunity for the acoustical frequencies to be attenuated by canceling each other where they meet.

From the foregoing description and accompanying drawings, and by way of summation, it will now be evident that the present invention contemplates a muffler 8 for use with an internal combustion engine which provides effective attenuation of noise transmitted within the fluid exhaust flow of the internal combustion engine while developing only a low back pressure in the flow, provides for compact and economical construction, produces a reliable and rugged muffler suitable for automotive racing use, and is compatible with under vehicle mounting. In the illustrated exemplary embodiment, the outer casing 10 of muffler 8 has a generally long and narrow exterior configuration, a hollow interior and first and second end portions disposed respectively at opposite longitudinal ends of casing 10 and respectively closed by the end caps 12 and 14 respectively mounted therein. The frustoconically shaped entrance and exit collars 20 and 22 are located one at each of the opposite end portions of outer casing 8, and integral or separate entrance and exit ducts 16 and 18 are connected to and communicate respectively with collars 20 and 22. Ducts 16 and 18 protrude from an associated one of the opposite ends of casing 8 via end caps 12 and 14 respectively. The nested tube assembly or array 24 is composed of at least three of the open ended perforated tubes 21, 23, 25, 27, 29, 31, 33 which are disposed in direct supporting lateral engagement with mutually adjacent ones of such tubes. Tube assembly 24 extends longitudinally between the entrance and exit collars in laterally spaced relation to casing 8, and each tube has first and second open end portions disposed respectively at opposite longitudinal ends thereof. The entrance and exit collars 20 and 22 are crimped at their largest ends respectively in surrounding relation to an array of the first and second end portions of the tubes of the tube assembly.

The nested tube assembly 24 facilitates assembly of the muffler, stiffens the array of tubes and increases the communication of the holes or perforations 28 between the tubes to increase collisions and canceling between the acoustical frequencies of noise produced by exhaust gases. The sound absorbing material 26 is disposed in the interior of the casing in the space defined between the tube assembly and the outer casing and provides for further attenuation of the acoustical frequencies of noise produced by the exhaust gas.

The apparatus also embodies one mode of practicing the method of the invention, namely improved noise attenuation and reduced back pressure is produced due to the combined effect of the following steps comprising the method of noise reduction. Exhaust gas is rapidly expanded transversely to its flow direction by directing the gas via entrance duct 16 into the frusto-conical divergent entrance collar 20. The exhaust gas is directed from collar 20 into an open entrance end of each of at least three of the perforated tubes 21, 23, 25, 27, 29, 31, 33 comprising the nested tube assembly or array 24, each of the tubes being open at longitudinally opposite ends thereof and arranged in direct supporting relation to mutually adjacent ones of the tubes whereby frequency components of the noise are transmitted through the perforations 28 of the tubes and into the space between the tubes where the components cancel. Additionally, some of the exhaust gas flows from one of the tubes directly into another of the tubes through the perforations. Some of the exhaust gas from the tubes is allowed to flow from one or more of the tubes into the dampening chamber between the tube array and casing 8, which is filled with sound attenuating material 26, and then is redirected from the chamber back into one or more of the tubes. Noise attenuation is also produced by transmission of frequency components of noise of the sound absorbing material 26 within the dampening chamber. A portion of the exhaust gases flows straight through each of the tubes without communicating between the tubes, wherein noise attenuation is solely provided by transmission of frequency components of noise contained therein through the perforations, whereby the noise is canceled as components collide in the space between the tubes, or components are absorbed by the sound absorbing material contained within the sound absorbing material contained within the dampening chamber. All of the exhaust gas entering the muffler 8 is redirected into the exit collar 22, acting as an exit collector, and is collected and removed by exit duct 18 into a vehicle exhaust system. Further silencing of the flow of exhaust gas may be provided by locating at least one venturi 21, 23, 25, etc. at a selected location in at least one of the tubes 21, 23, 25, 27, 29, 31, 33 to tune the exhaust system by contracting and expanding the exhaust gases as they are forced through such venturi.

It will also be evident that the muffler 8 embodies a novel sub-combination that comprises at least three of the perforated tubes 21', 23', 25', 27', 29' 31', 33' arranged in direct supporting relation to mutually adjacent ends of the tubes to form the nested tube assembly 24 and being supported by a collar 20 or 22. The collar 20 or 22 extends via an associated duct 16 or 18 through an associated one casing end cap 12 or 14. The collar has a frusto conically shaped portion 35 or 41 divergent toward the larger end of the collar. The large collar end closely overlaps the associated open ends of the nested tube assembly in surrounding supporting relation to the array of such tube open ends. At least these open ends of the tubes of the assembly are in direct supporting lateral engagement with mutually adjacent ones of such one tube open ends, and the large collar end is preferably crimped against the array of the associated open ends of the tubes.

Additionally, a cone, as can be formed by crimping the center tube 33', may be disposed centrally within the collar, having an exterior surface disposed in spaced relation to a surrounding interior surface 35 or 41 of the collar. The cone has a vertex end extending toward the small end of the collar and a base end opposite the vertex and disposed at a central zone of the array of the open ends of the tubes to provide for unobstructed gas flow between the open tube ends and the small end of the collar in the space defined between the interior surface of the collar and the exterior surface of the cone. As a further refinement at least one of the tubes may have a venturi 21, 23, 25, etc. therein disposed at a selected location therealong for creating a tuning effect therein by contracting and expanding the exhaust gases as they are forced through the venturi.

While various novel features of the present invention have been shown and described and are pointed out in the accompanying claims, with particular reference to the disclosed embodiment, it will be understood by those skilled in the art that with the benefit of the foregoing disclosure, various omissions, substitutions, variations and modifications can be made for the present invention, and therefore the scope of the present claims are intended to be limited only by the applicable prior art.

I claim:

1. A muffler for use with an internal combustion engine comprising:

an outer casing having a hollow interior and first and second end portions disposed respectively at opposite longitudinal ends of said casing, end caps mounted one at each of said end portions of said outer casing, frustoconically shaped entrance and exit collar located one at each of said opposite end portions of said outer casing, entrance and exit ducts connected to and communicating respectively with said entrance and exit collars and protruding from an associated one of said opposite ends of said casing via an associated one of said end caps, respectively, a nested tube assembly composed of at least three open ended tubes in direct supporting lateral engagement with mutually adjacent ones of said tubes and extending longitudinally between said entrance and exit collars in laterally spaced relation to said casing and each having first and second open end portions disposed respectively at opposite longitudinal ends thereof, wherein at least one of said tubes is perforated and at least one of said tubes is non-perforated, said entrance and exit collars being crimped at their largest ends respectively in surrounding relation to an array of said first and second end portions of said tubes of said tube assembly, and sound absorbing material disposed in the interior of said casing in the space defined between said tube assembly and said outer casing.

2. A muffler as in claim 1 wherein said tubes are straight.

3. The muffler as in claim 2 wherein said tubes of said tube assembly have equal diameters.

4. The muffler as in claim 2 wherein at least some of said tubes of said tube assembly have diameters varying in size relative to the reminder of said tubes.

5. The muffler as in claim 1 wherein at least one of said tubes of said tube assembly is partially crimped along its length at a selected location to form a venturi structure and effect in said one tube.

6. The muffler as in claim 1 wherein one of said tubes is completely closed by a crimped portion located between said end portion thereof and a perforated cone is attached at said first end of said one tube.

7. The muffler as in claim 2 wherein said tubes of said tube assembly each have a non-circular configuration in cross-section transverse to the longitudinal axis of the associated tube.

8. The muffler as in claim 2 wherein each of said tubes of said tube assembly have flat sides.

9. The muffler as in claim 1 wherein said casing is of a non-circular configuration.

10. The muffler as in claim 1 wherein said casing is of a circular configuration in cross-section taken transverse to the longitudinal axis thereof.

11. The muffler as in claim 2 wherein each of said tubes of said tube assembly have a circular configuration in cross-section transverse to the longitudinal axis of the associated tube.

12. The muffler as in claim 1 wherein said tubes are twisted in a helical tube.

13. The muffler as in claim 12 wherein said tubes of said tube assembly each have circular configuration in cross-section transverse to the longitudinal axis of the associated tube.

14. The muffler as in claim 12 wherein said tubes of said tube assembly each have a non-circular configuration in cross-section transverse to the longitudinal axis of the associated tube.

15. The muffler as in claim 12 wherein said tubes of said tube assembly each have flat sides.

16. A method for silencing a flow of exhaust gas from an internal combustion engine comprising the steps of:

directing said exhaust gas into an entrance collar;

allowing said exhaust gas to rapidly expand transversely to its flow direction upon entering said entrance collar;

directing said exhaust gas from said entrance collar into an open entrance end of each of at least three (3) tubes open at longitudinally opposite ends thereof and arranged in direct supporting relation to mutually adjacent ones of said tubes, wherein at least one of said tubes is perforated and at least one of said tubes is non-perforated;

allowing some of said exhaust gas to flow from one of said perforated tubes directly into another of said perforated tubes;

allowing some of said exhaust gas from said perforated tubes to flow from one or more of said perforated tubes into a dampening chamber filled with sound attenuating material;

allowing some of said exhaust gas to flow straight through each of said non-perforated tubes via the opposite ends thereof;

redirecting said exhaust gas from said dampening chamber back into one or more of said perforated tubes;

directing all of said exhaust gas initially admitted to said entrance ends of said tubes to flow from an exit end of each of said tubes into an exit collector, and removing said exhaust gas from said exit collector.

17. The method for silencing a flow of exhaust gas of claim 16 comprising the additional steps of:

locating at least one venturi structure at a selected location in at least one of said tubes for creating a tuning effect therein by contracting and expanding the exhaust gases as they are forced through said one venture structure thus affording a further opportunity for the frequencies to collide and cancel each other out to provide for further sound attenuation.

18. The method for silencing a flow of exhaust gas of claim 17 comprising the additional step of:

forming said one venturi structure by crimping or necking down said one tube at a predetermined selected spaced location along its length.

19. A muffler for use with an internal combustion engine comprising:

a nested tube assembly composed of at least three perforated tubes and at least one non-perforated tube each open at longitudinal opposite entrance and exit open end thereof and each extending longitudinally of and within said casing;

said tubes each having at least one of said entrance and exit open ends thereof disposed generally coplanar with the remaining associated open ends of said tubes within said casing;

an open ended collar having large and small open ends and being located adjacent one end of said outer casing with said small collar and extending through said one casing end, said collar having a frusto-conically shaped portion divergent toward said large collar end, said large collar end closely overlapping said one open ends of said tube assembly in surrounding supporting relation to the array of said one open ends of said tubes, at least said one open ends of said tubes of said tube assembly being in direct supporting lateral engagement with mutually adjacent ones of said one open ends of said tubes.

20. A muffler as set forth in claim 19 wherein sound absorbing material is disposed in an interior casing space defined between said tube assembly and said outer casing.

21. The muffler as set forth in claim 19 wherein said large collar end is crimped against said array of said one open ends of said tubes.

22. The muffler as set forth in claim 21 wherein said one open ends of said tubes are attached by weldments to mutually adjacent ones of said one open ends of said tubes.

23. The muffler as set forth in claim 22 wherein said one open ends of said tubes comprise said exit open ends of said tubes.

24. The muffler as set forth in claim 19 wherein a cone is disposed centrally within said collar and has an exterior surface disposed in spaced relationship to a surrounding interior surface of said collar, said cone having a vertex end extending toward said small end of said collar and having a base end opposite said vertex and disposed at a central zone of the array of said open ends of said tubes such that gas flow between said open tube ends and said small end of said collar can occur unobstructedly in the space defined between the interior surface of said collar and the exterior surface of said cone.

25. A muffler for use with an internal combustion engine comprising:

an outer casing;

a nested tube assembly composed of at least three perforated tubes and at least one non-perforated tube, each said tube being open at longitudinal opposite entrance and exit open ends thereof and each extending longitudinally of and within said casing;

said tubes each having at least one of said entrance and exit open ends thereof disposed within said casing;

open ended collar means located adjacent one end of said outer casing with one end thereof extending through said one casing end;

said collar having a portion overlapping said one open ends of said tube assembly in surrounding supporting relation to the array of said one open ends of said tubes;

and at least one of said tubes having venturi structure therein disposed at a selected location therealong for creating a tuning effect therein.

26. The method for tuning an internal combustion engine muffler to produce a desired exhaust sound, comprising providing said muffler with an array of tubes all of which are connected at an inlet end of the muffler to and in gas communication with an engine exhaust manifold section and all of which are connected at an outlet end of the muffler to and in gas communication with a tail pipe section, wherein said tuning is accomplished thru the selection of the following structural parameters, (a) the length of each tube, (b) the volumetric capacity of each tube, e.g., tube diameter and tube length, (c) the shape of each tube, (d) the location of the array or arrays within the muffler can, (e) the number of perforated tubes and the perforation pattern and the % of open (perforated) area, (f) the number of non-perforated tubes, (g) the ratio of perforated tubes to non-perforated tubes is from 10/1-1/10, (h) the % of perforated wall area of each perforated tube is from about 20.0% to about 40.0%; and (i) where and how many venturi restrictions (can be random are provided).

* * * * *